US009469471B2

(12) United States Patent
Dran et al.

(10) Patent No.: US 9,469,471 B2
(45) Date of Patent: Oct. 18, 2016

(54) BEVERAGE CAPSULE

(75) Inventors: Dennis Timothy Dran, New Milford, NJ (US); Scott Hanneson, Mississauga (CA); Daud Ahmed Khan, Whitby (CA); Liberatore A. Trombetta, Ancaster (CA)

(73) Assignee: 2266170 Ontario Inc., Mississauga, ON (CA)

( * ) Notice: Subject to any disclaimer, the term of this patent is extended or adjusted under 35 U.S.C. 154(b) by 1028 days.

(21) Appl. No.: 13/020,167

(22) Filed: Feb. 3, 2011

(65) Prior Publication Data

US 2012/0201933 A1 Aug. 9, 2012

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
USPC ..... 426/80; 99/295
See application file for complete search history.

(56) References Cited

U.S. PATENT DOCUMENTS

| | | | |
|---|---|---|---|
| 5,008,013 | A | 4/1991 | Favre et al. |
| 5,897,899 | A | 4/1999 | Fond |
| 6,607,762 | B2 | 8/2003 | Lazaris et al. |
| 6,758,130 | B2 | 7/2004 | Sargent et al. |
| 6,841,185 | B2 | 1/2005 | Sargent et al. |
| 7,153,530 | B2 | 12/2006 | Masek et al. |
| 7,279,188 | B2 | 10/2007 | Arrick et al. |
| 7,543,527 | B2 | 6/2009 | Schmed |
| 7,552,672 | B2 | 6/2009 | Schmed |
| 7,624,673 | B2 | 12/2009 | Zanetti |
| 7,685,930 | B2 | 3/2010 | Mandralis et al. |
| 7,763,300 | B2 | 7/2010 | Sargent et al. |
| 7,798,055 | B2 | 9/2010 | Mandralis et al. |

(Continued)

FOREIGN PATENT DOCUMENTS

| | | |
|---|---|---|
| EP | 1859683 | 11/2007 |
| EP | 2230195 | 9/2010 |

(Continued)

OTHER PUBLICATIONS

Ephraim, D., Coffee Grinding and Its Impact on Brewed Coffee Quality, Tea & Coff Trade Journal, Nov. 2005. [on line], retrieved Jul. 7, 2013. Retrieved from the Internet: URL:<http://www.mpechicago.com/coffee/images/uploads/pdfs/COFFEE_GRINDING_Nov03.pdf>.*

European Search Report & Opinion in EP12153751, dated May 4, 2012.

*Primary Examiner* — Erik Kashnikow
*Assistant Examiner* — C Smith
(74) *Attorney, Agent, or Firm* — Manelli Selter PLLC; Edward J. Stemberger

(57) ABSTRACT

A beverage capsule is provided for use in a beverage preparing machine. The beverage capsule includes a body having a sidewall and a base defining an interior space. A first opening is defined at one end of the body and a second opening is defined at an opposing end of the body. A first cover covers the first opening and a second cover covers the second opening. A filter is disposed in the interior space a pre-determined distance away from the second opening. Ingredients, such as ground coffee beans, are disposed in the interior space between the first opening and the filter for preparing a desired beverage, wherein the ingredients have a statistical arithmetic mean particle size that is greater than 600 microns.

12 Claims, 3 Drawing Sheets

(56) References Cited

U.S. PATENT DOCUMENTS

| | | | | |
|---|---|---|---|---|
| 2003/0005826 | A1 | 1/2003 | Sargent et al. | |
| 2005/0150390 | A1* | 7/2005 | Schifferle | 99/295 |
| 2007/0148290 | A1 | 6/2007 | Ternite | |
| 2009/0324791 | A1 | 12/2009 | Ohresser et al. | |
| 2010/0028495 | A1 | 2/2010 | Novak et al. | |

FOREIGN PATENT DOCUMENTS

| | | |
|---|---|---|
| WO | 2010085824 | 8/2010 |
| WO | 2011095518 | 8/2011 |

* cited by examiner

BEVERAGE CAPSULE

FIELD

This specification relates to beverage capsules and in particular to beverage capsules adapted for use in beverage preparing machines.

BACKGROUND

The following background discussion is not an admission that anything discussed below is citable as prior art or common general knowledge. The documents listed below are incorporated herein in their entirety by this reference to them.

There is a growing popularity in the use of beverage capsules in beverage preparing machines for preparing individual servings of a desired beverage. One example of a beverage capsule adapted for preparing a beverage in a beverage preparing machine is disclosed in published PCT patent application WO 2010/085824. This capsule includes a body having a filter device disposed at the base. An extractable substance in powder form, in particular a coffee powder, is disposed in the capsule between the filter device and the capsule lid. The filter device has a planar filter surface that defines a plurality of openings. The openings have a diameter of 0.4 millimeters on the side of the filter device that faces the coffee powder. The openings maintain this diameter and have a cylindrical cross section through a portion of the thickness of the filter device and then widen conically at an angle of approximately 40 degrees so that the size of openings on the side facing the base of the capsule is larger than the size of the openings facing the coffee powder. This is provided to facilitate flow-through of liquid under a high pressure and reduce the risk of blockage of the openings by the coffee powder.

High pressure beverage preparing machines are primarily designed for preparing espresso style beverages that include a crema (foam). Crema is very desirable for espresso style beverages and is an important feature for authenticity of such beverages.

Traditional espresso is prepared with a manual or semi-automatic espresso machine in which the coffee beans are ground to a desired mean particulate size of typically 200-300 microns and "hand tamped" with a tamper. Such manual or semi-automatic espresso machines are noted for producing a thick rich crema.

Many modern high pressure fully automatic beverage preparing machines that utilize single serve beverage capsules are designed with the intention to replicate the crema produced by hand-tamped espresso machines with the intention of creating an authentic espresso style beverage without the effort of hand tamping. This desirable crema is composed mostly of foam and tiny bubbles. The foam and bubbles are principally created through the creation of turbulence and high pressure within the beverage capsule during the preparation process. For this reason modern high pressure fully automatic beverage preparing machines have brewing chambers and dispensing systems designed to produce turbulence as the extracted coffee passes through the filtering and dispensing system. The capsules often have openings in the filtering media which are very small and with sharp or abrupt entrance and exit holes which increase turbulence in the stream of the coffee extracting and dispensing system.

Some individuals prefer beverages that more closely resemble a North American drip-style beverage in appearance and taste. The North American drip-style beverage is characterized by a lighter beverage color and strength and minimal or no foam, bubbles or crema. It is desirable that such beverages may be prepared in the same high pressure fully automatic beverage preparing machines that are used for preparing espresso style beverages with crema so that a single machine may serve a variety of beverage tastes.

One example of a beverage capsule adapted for preparing a North American drip-style coffee in a high pressure fully automatic beverage preparing machine is disclosed in U.S. Pat. No. 7,552,672. This capsule includes a body having an aperture defined in the base that is covered by a seal that may be removed by the user or punctured by the machine. A filter element is disposed at the base of the capsule to separate the coffee powder in the capsule from the aperture. The filter element includes a plurality of apertures that are adapted to allow liquid to pass through the filter element while preventing passage of undissolved coffee grounds. The coffee powder is relatively coarsely ground with the arithmetic mean diameter of the particles being between 400 to 600 microns.

A problem with the capsule disclosed in the '672 patent is that the resulting coffee maintains some crema and does not sufficiently resemble a North American drip-style beverage in appearance and taste.

Another example of a beverage capsule adapted for preparing a North American drip-style coffee in a high pressure fully automatic beverage preparing machine is disclosed in FIG. 7 of U.S. Pat. No. 7,685,930. This capsule includes a body having a permeable retaining wall that is supported by a support plate proximate to the base of the capsule. The retaining wall has a plurality of openings or pores enabling the flow of beverage there through. The retaining wall may be made of paper or fibres or other materials. The support plate may be in the form of a grid or an apertured rigid corrugated plate that allows beverage to flow through at relatively low pressures so that the production of foam is minimized or prevented.

A problem with the capsule disclosed in the '930 patent is that it includes an internal shoulder to which the "permeable retaining wall" is welded. This internal shoulder restricts the cross-sectional area available for the filtering element. Furthermore, welding a filter to an internal shoulder is difficult to accomplish, which increases the cost and complexity of the filling line and increases the risk of quality issues arising due to improper capsule assembly.

Another example of a beverage capsule adapted for preparing a North American drip-style coffee in a high pressure fully automatic beverage preparing machine is disclosed in published US patent application 2007/0148290. This capsule includes a body having a screening device with large-surface-area cutouts separated by radial ribs. A planar textile fabric which serves as a filter is disposed within the capsule between the beverage ingredients and the cutouts. The screening device is spaced from the base of the capsule by an annular structure having a narrower diameter than the screening device. The annular structure includes a plurality of through openings arranged generally perpendicular to the base of the capsule for allowing the passage of beverage from an outer region below the screening device to an inner region below the screening device. The capsule further includes an opening defined in the base of the capsule that is sealed by a sheet material. The opening is penetrated during use of the capsule by the beverage preparing machine to allow beverage to flow through the opening into a user's cup.

A problem with the capsule disclosed in the '290 application is that the support structure includes a conical protuberance, which necessitates that the planar textile fabric be cut into an annular structure. This is difficult to accomplish, which increases the cost and complexity of the machine for cutting the fabric and assembling the fabric to the support structure. It also increases the risk of quality issues arising due to improper assembly of the fabric structure. The small piece that is punched out of the center of the fabric also becomes a potential source of contamination should it not be properly removed and end up under the disk in the final capsule assembly. A further problem with this capsule is that it requires an annular structure with through-openings underneath the fabric. This structure can restrict the beverage flow and increase turbulence, potentially leading to increased levels of crema in the finished beverage.

It is desirable that a beverage capsule be developed for preparing North American drip-styled beverages in beverage preparing machines that improves upon existing beverage capsules.

SUMMARY

In one aspect the invention provides a beverage capsule for use in a high pressure beverage preparing machine, the beverage capsule comprising:

a body having a sidewall and a base defining an interior space;

a first opening defined at one end of said body opposing said base, said first opening being covered by a first cover;

a second opening defined in said base, said second opening being covered by a second cover;

a filter disposed in said interior space a pre-determined distance away from said second opening; and ground coffee beans disposed in said interior space between said first opening and said filter, wherein said ground coffee beans have a statistical arithmetic mean particle size that is greater than 600 microns.

In another aspect the invention provides a beverage capsule for use in a beverage preparing machine, the beverage capsule comprising:

a body having a sidewall and a base defining an interior space;

a first opening defined at one end of said body opposing said base, said first opening being covered by a first cover;

a filter disposed in said interior space a pre-determined distance away from said base; and ingredients disposed in said interior space between said first opening and said filter for preparing a desired beverage, wherein said ingredients have a statistical arithmetic mean particle size that is greater than 600 microns.

In another aspect the invention provides a beverage capsule for use in a high pressure beverage preparing machine, the beverage capsule comprising:

a body having a sidewall and a base defining an interior space;

a first opening defined at one end of said body opposing said base, said first opening being covered by a first cover;

a second opening defined in said base, said second opening being covered by a second cover;

a support member having an annular wall disposed on an interior surface of said base, said support member having a plurality of support ribs defining a surface spaced a pre-determined distance from said second opening;

a filter disposed on said support member; and ground coffee beans disposed in said interior space between said first opening and said filter, wherein said ground coffee beans have a statistical arithmetic mean particle size that is greater than 600 microns.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

Figure 1:
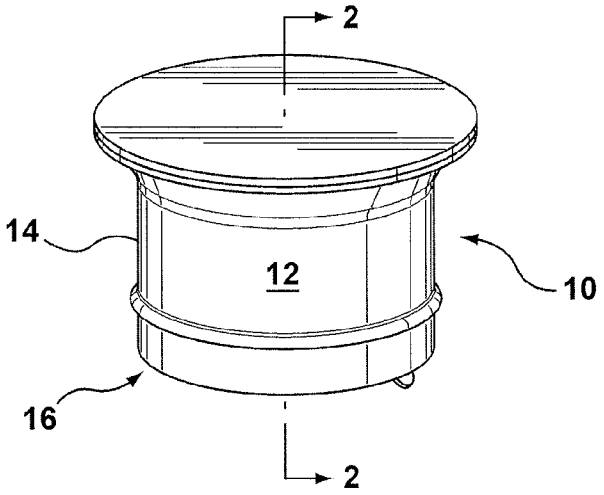
FIG. 1 is a perspective view of a beverage capsule in accordance with the present invention.
Figure 2:
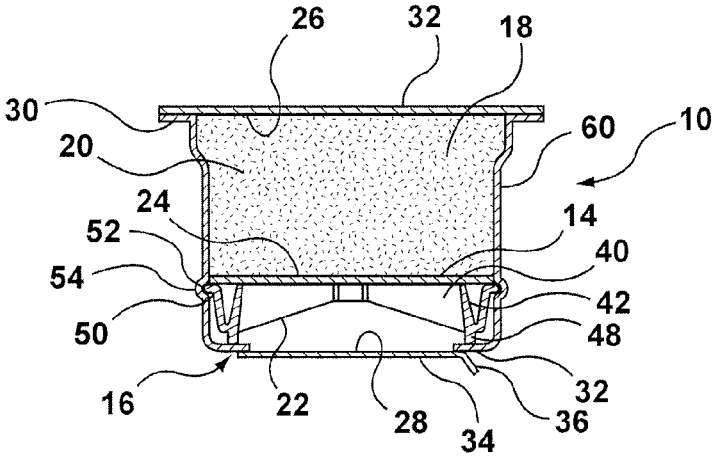
FIG. 2 is a sectional view of the beverage capsule shown in FIG. 1 as viewed along lines 2-2.

A beverage capsule in accordance with the present invention is shown generally at 10 in FIGS. 1 and 2. Beverage capsule 10 includes a body 12 having a sidewall 14 and a base 16 defining an interior space 18 for receiving one or more ingredients 20. A support member 22 is disposed in capsule 10 for supporting a filter 24.

A first opening 26 is defined at one end of body 12 and a second opening 28 is defined at the opposing end of body 12. The second opening 28 is sized to permit sufficient airflow through capsule 10 during use in a high pressure beverage preparing machine to minimize or eliminate higher pressure within the capsule 10. Preferably, second opening 28 occupies at least fifty percent of the cross-sectional surface area at the base 16 of the capsule 10 and more preferably at least seventy-five percent of the cross-sectional surface area.

An outwardly projecting flange 30 extends around the perimeter of first opening 26. A first cover 32 is disposed over first opening 26 and secured to outwardly projecting flange 30.

An inwardly projecting flange 32 extends about the perimeter of second opening 28. A second cover 34 is disposed over second opening 28 and secured to inwardly projecting flange 32 on the outer surface of capsule 10. A tab 36 is provided on second cover 34 to allow second cover 34 to be manually removed by a user prior to insertion in a beverage preparing machine.

Support member 22 includes a plurality of ribs 40 extending from an annular wall 42 for supporting filter 24. Support ribs 40 may extend radially inwards from annular wall 42 to a centre point such as inner hub 44. Support ribs 40 may alternatively be arranged in a grid pattern or any other pattern that provides sufficient support for filter 24 during use of capsule 10 in a high pressure beverage preparing machine.

Flow openings 46 are defined between support ribs 40. Flow openings 46 are sized to facilitate flow of liquid through support member 22 with minimal backpressure. The open area defined by flow openings 46 is preferably within the range of 60-97 percent of the overall interior cross-sectional surface area of capsule 10, more preferably within the range of 70-95 percent and even more preferably within the range of 80-90 percent.

A footing 48 is defined at the base of annular wall 42 for supporting support member 22 on an interior surface of base 16 adjacent to sidewall 14. Footing 48 is preferably sized to define sufficient space below filter 24 to avoid the filter 24 being pierced by a discharge probe (not shown) that may extend into second opening 28 during use of capsule 10 with certain types of beverage preparing machines.

Figure 3:
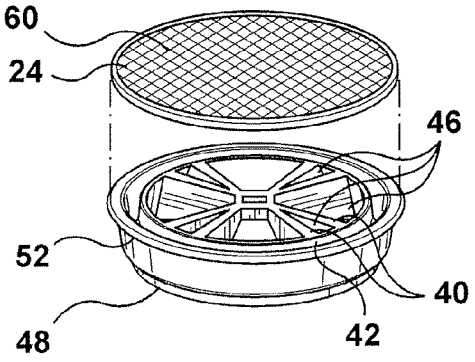
FIG. 3 is an exploded view of the filter and support member for the beverage capsule shown in FIGS. 1 and 2.

In the embodiment depicted in FIGS. 2 and 3, a resilient annular flange 50 extends upwardly and outwardly from the base of annular wall 44 of support member 22. A first snap fit component 52 is defined on flange 50 for fitting to a corresponding second snap fit component 54 defined in sidewall 14 of capsule 10. In the depicted embodiment, first snap fit component 52 comprises a lip for fitting to second snap fit component 54 comprising a corresponding groove. It will be understood that other arrangements of snap fit components 52 and 54 may be provided including a reverse arrangement with a lip defined on sidewall 14 of capsule for fitting to a groove defined on annular flange 50.

Figure 4:
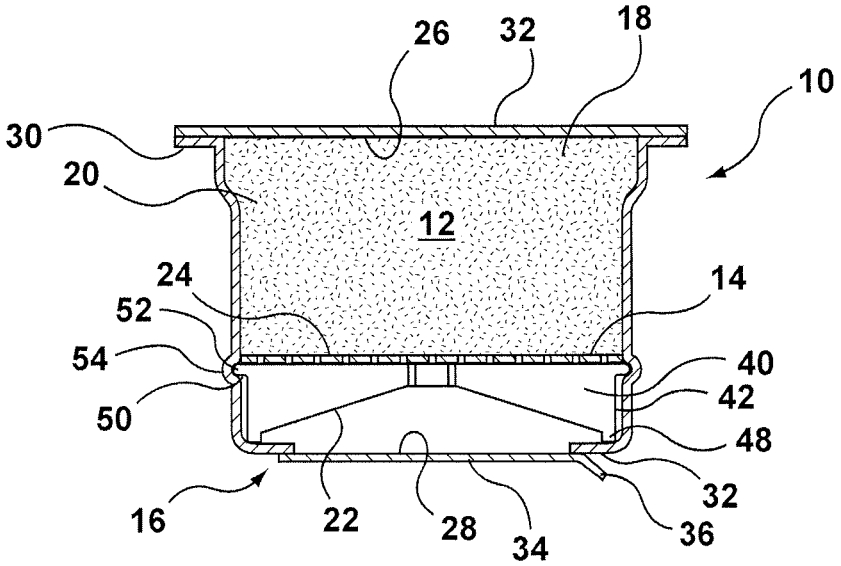
FIG. 4 is a sectional view of a second embodiment of the beverage capsule shown in FIG. 1 as viewed along lines 2-2.
Figure 5:
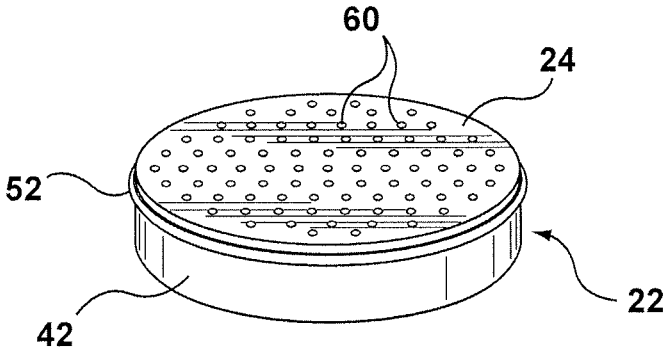
FIG. 5 is an exploded view of the filter and support member for the second embodiment of the beverage capsule shown in FIG. 4.

In a second embodiment of capsule 10 as shown in FIGS. 4 and 5, annular wall 44 defines the outer periphery of support member 22 with no resilient annular flange being provided. First snap fit component 52 is defined on annular wall 44 for fitting to corresponding second snap fit component 54 as described above.

In the embodiments depicted in FIGS. 2-5, filter 24 is disposed on the surface of support member 22 that faces interior space 18. In further alternative embodiments as shown in FIGS. 6 and 7, filter 24 may be disposed in capsule 10 without the aid of a separate support member 22.

Figure 6:
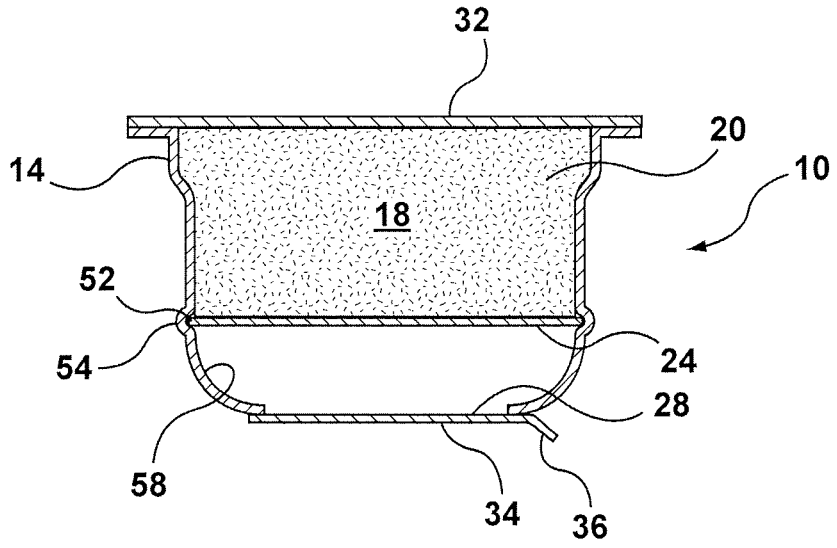
FIG. 6 is a sectional view of a third embodiment of the beverage capsule shown in FIG. 1 as viewed along lines 2-2.

In a third embodiment of capsule 10 depicted in FIG. 6, filter 24 has a peripheral edge that functions as a first snap fit component 52 adapted to for fitting to a second snap fit component 54 defined in sidewall 14 of capsule 10. In a fourth embodiment of capsule 10 depicted in FIG. 7, filter 24 is disposed on a shoulder 56 defined in sidewall 14 of capsule 10. Capsule 10 may further include a sloped inner surface 58 below filter 24 for directing the prepared beverage toward second opening 28.

Filter 24 may be formed of one or more materials including paper, textiles, sponge, metal or plastics. Certain filter materials, such as paper, are typically used in the preparation of North American drip-style coffee and are known to absorb certain oils which may suit certain taste preferences. Plastic filter materials are more commonly used in capsules for high pressure beverage preparing machines.

Figure 7:
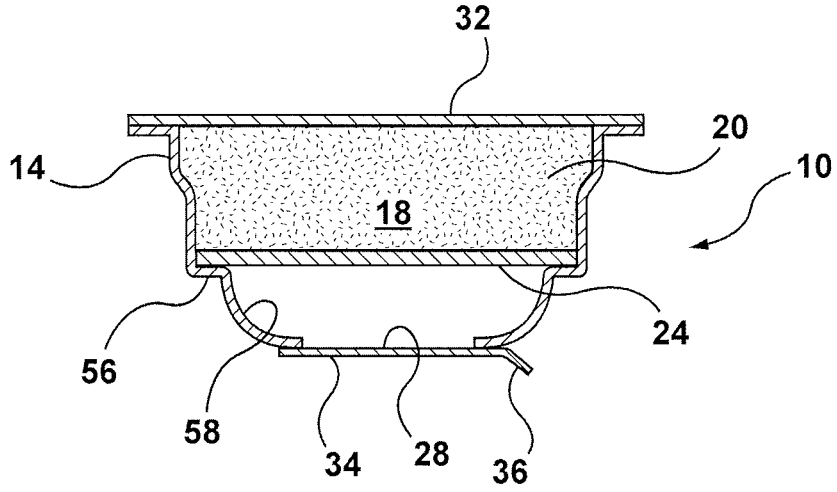
FIG. 7 is a sectional view of a fourth embodiment of the beverage capsule shown in FIG. 1 as viewed along lines 2-2.

For capsules 10 adapted for use in a high pressure beverage preparing machine, a plastic or metal filter 24 (on its own as shown in FIGS. 6 and 7 or with a support member as shown in FIGS. 2-5) or a paper filter 24 (with a support member 22 as shown in FIGS. 2-5) is preferred for withstanding the high pressures created within the capsule.

Filter 24 is adapted for filtering undissolved solids and other undesired elements from the ingredients 20 disposed in capsule 10 as described below. Filter 24 may have a plurality of pore openings 60 each having a largest dimension in the range 400 to 600 microns, preferably 450 to 550 microns and more preferably around 500 microns.

Pore openings 60 may have the same dimension at the upper and lower sides of filter 24 or pore openings 60 may have a smaller dimension at the lower side of filter 24 (the side facing second opening 28) to promote a laminar flow of liquid through the filter 24. Pore openings 60 preferably have smooth contours to promote laminar flow and deter turbulence in the liquid passing through the filter 24.

Ingredients 20 may include particles or powders adapted for preparing coffee, tea, chocolate, milk or combinations thereof or other desired beverages. Ingredients 20 either are adapted to dissolve completely or have particle sizes adapted to optimize solubility and extraction within the beverage preparation timelines associated with the desired beverage preparing machines.

Ingredients 20 that are not capable of completely dissolving during beverage preparation, such as ground coffee beans, have a statistical arithmetic mean particle size that is larger than the largest dimension of pore openings 60 for filter 24. The statistical arithmetic mean particle size of ingredients 20 such as ground coffee beans for the embodiments of filter 24 described above is in the range of 589 to 833 microns and preferably greater than 600 microns.

The distribution of particle sizes for the volume of ingredients 20, such as ground coffee beans, to be disposed in capsule 10 is in the range of zero to ten percent of ingredients having a particle size greater than 833 microns, eighty to one hundred percent of ingredients having a particle size between 833 and 589 microns, and zero to ten percent of ingredients having a particle size below 589 microns. Preferably, the distribution of particle sizes for the volume of ingredients 20, such as ground coffee beans, to be disposed in capsule 10 is ten percent of ingredients having a particle size greater than 833 microns, eighty percent of ingredients having a particle size between 833 and 589 microns and ten percent of ingredients having a particle size less than 589 microns.

While the above description provides examples of one or more processes or apparatuses, it will be appreciated that other processes or apparatuses may be within the scope of the accompanying claims.

We claim:

1. A beverage capsule for use in preparing a drip-style beverage in a high pressure beverage preparing machine, the beverage capsule comprising:

a body having a sidewall and a base defining an interior space; a first opening defined at one end of said body opposing said base, said first opening being covered by a first cover;

a second opening defined in said base, said second opening being covered by a second cover;

a filter disposed in said interior space a pre-determined distance away from said second opening; ground coffee beans disposed in said interior space between said first opening and said filter, wherein said ground coffee beans have a statistical arithmetic mean particle size that is greater than 600 microns with at least 80 percent of said ground coffee beans having a particle size in the range of 833 microns to 589 microns.

2. The beverage capsule of claim 1, further comprising a support member having an annular wall and a plurality of support ribs for supporting said filter in said capsule.

3. The beverage capsule as claimed in claim 2, wherein said filter comprises a material selected from paper, fabric or sponge.

4. The beverage material as claimed in claim 1, wherein said filter comprises a plastic material.

5. The beverage capsule of claim 1, wherein said filter has a plurality of pore openings having a largest dimension in the range of 400 to 600 microns.

6. The beverage capsule of claim 5, wherein said pore openings have said largest dimension on the portion of said filter facing said ground coffee beans.

7. The beverage capsule of claim 1, wherein said second cover is removably secured to an outer surface of said base.

8. The beverage capsule of claim 1, wherein said capsule has a sloped inner surface located between said filter and said second opening for directing coffee toward said second opening.

9. The beverage capsule of claim 1, wherein said second opening occupies at least fifty percent of the cross-sectional surface area of said capsule at said base.

10. A beverage capsule for use in preparing a drip-style beverage in a high pressure beverage preparing machine, the beverage capsule comprising:

a body having a sidewall and a base defining an interior space; a first opening defined at one end of said body opposing said base, said first opening being covered by a first cover;

a second opening defined in said base, said second opening being covered by a second cover;

a support member having an annular wall disposed on an interior surface of said base, said support member having a plurality of support ribs defining a surface spaced a pre-determined distance from said second opening;

a filter disposed on said surface of said support member; ground coffee beans disposed in said interior space between said first opening and said filter, wherein said ground coffee beans have a statistical arithmetic mean particle size that is greater than 600 microns with at least 80 percent of said ground coffee beans having a particle size in the range of 833 microns to 589 microns.

11. The beverage capsule of claim 10, wherein said filter has a plurality of pore openings having a largest dimension in the range of 400 to 600 microns.

12. The beverage capsule of claim 10, wherein said second cover is removably secured to an outer surface of said base.

* * * * *